US012385388B2

(12) United States Patent
Kanfar et al.

(10) Patent No.: US 12,385,388 B2
(45) Date of Patent: Aug. 12, 2025

(54) DYNAMIC REAL TIME GROSS RATE MONITORING THROUGH SUBSURFACE AND SURFACE DATA

(71) Applicant: Saudi Arabian Oil Company, Dhahran (SA)

(72) Inventors: Mohammed S. Kanfar, Dammam (SA); Ali Saleh Alshehri, Dammam (SA); Kalid Saad Dosary, Khobar (SA); Abdulaziz A. Alsaleh, Dammam (SA); Hussain M Al-Zahrani, Dammam (SA); Ahmed K Bubshait, Dhahran (SA); Osama M Kheshaifaty, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 277 days.

(21) Appl. No.: 17/934,090

(22) Filed: Sep. 21, 2022

(65) Prior Publication Data

US 2024/0093596 A1 Mar. 21, 2024

(51) Int. Cl.
*E21B 47/10* (2012.01)
*E21B 43/12* (2006.01)

(52) U.S. Cl.
CPC ..... *E21B 47/10* (2013.01); *E21B 43/128* (2013.01); *E21B 2200/20* (2020.05); *E21B 2200/22* (2020.05)

(58) Field of Classification Search
CPC .... E21B 47/10; E21B 43/128; E21B 2200/20; E21B 2200/22; F04D 13/08; F04D 13/086; F04B 2205/09
See application file for complete search history.

(56) References Cited

U.S. PATENT DOCUMENTS 9,720,424 B2 8/2017 Ige et al.
11,091,989 B1 8/2021 De Oliveira et al.
(Continued)

FOREIGN PATENT DOCUMENTS

WO 2016153895 A1 9/2016

OTHER PUBLICATIONS

Sergio Caicedo at al.; Estimating Flow Rates Based on ESP Down Hole Sensor Data; Paper SPE 163324 presented at the SPE Kuwait International Petroleum Conference and Exhibition, Kuwait City, Kuwait, Dec. 10-12, 2012.; 7 pages.
(Continued)

*Primary Examiner* — Mohammad K Islam
(74) *Attorney, Agent, or Firm* — Leason Ellis LLP

(57) ABSTRACT

Continuous gross rate of each of a plurality of wells is estimated. Information provided by sensors configured with each of a plurality of electrical submersible pumps is received. Information associated with a respective model of each of the plurality of electrical submersible pumps is accessed. Utilizing at least one of artificial intelligence and machine learning, the information provided by sensors and the information associated with the respective model of each of the plurality of electrical submersible pumps is processed to estimate a first gross rate of each of the plurality of wells. A second gross rate of each of the plurality of wells is estimated via a pipeline simulation that applies a physics-based model. A continuous gross rate for each of the plurality of wells is estimated as a function the first gross rate and the second gross rate.

18 Claims, 9 Drawing Sheets

(56) References Cited

U.S. PATENT DOCUMENTS

| | | | | |
|---|---|---|---|---|
| 2005/0114031 | A1 | 5/2005 | Thambynayagam et al. | |
| 2008/0234939 | A1 | 9/2008 | Foot et al. | |
| 2011/0040501 | A1 | 2/2011 | Martin et al. | |
| 2018/0171774 | A1 | 6/2018 | Ringer et al. | |
| 2018/0306693 | A1* | 10/2018 | Nazari | E21B 47/06 |
| 2019/0323323 | A1 | 10/2019 | Zhang et al. | |
| 2021/0123334 | A1 | 4/2021 | Madasu et al. | |
| 2021/0181374 | A1* | 6/2021 | Sandnes | G06F 30/18 |
| 2021/0248500 | A1 | 8/2021 | Amur Varadarajan et al. | |
| 2021/0372243 | A1* | 12/2021 | Arukhe | F03G 7/122 |
| 2023/0194320 | A1* | 6/2023 | Arellano | E21B 47/103 166/250.01 |
| 2023/0399938 | A1* | 12/2023 | Hernandez de la Bastida | E21B 37/06 |

OTHER PUBLICATIONS

Al-Ali, et al.; Innovative Integrated Approach for Real-Time Liquid Rate Estimation for ESP Wells Production Optimization and Field Production Reconciliation in the Sabriyah Digital Oil Field. International Petroleum Technology Conference.; https://doi.org/10.2523/IPTC-18160-MS; Dec. 2014; 9 pages.

Hansen, et al.; Multi-Phase Flow Metering in Offshore Oil and Gas Transportation Pipelines: Trends and Perspectives; www.ncbi.nlm.nih.gov/pmc/articles/PMC6539503/; Jan. 2019.; 27 pages.

Anvari, et al.; Sampling/stochastic dynamic programming for optimal operation of multi-purpose reservoirs using artificial neural network-based ensemble streamflow predictions; https://www.researchgate.net/publication/285625871_Samplingstochastic_dynamic_programming_for_optimal_operation_of_multi-purpose_reservoirs_using_artificial_neural_network-based_ensemble_streamflow_predictions; Jul. 2014.; 15 pages.

Gryzlov, et al.; Intelligent Production Monitoring with Continuous Deep Learning Models; https://onepetro.org/SPERPTC/proceedings-abstract/21RPTC/3-21RPTC/D031S017R003/470351; Oct. 2021.; 20 pages.

Adesanwo, et al.; Interpreting Downhole Pressure and Temperature Data from ESP Wells by Use of Inversion-Based Methods in Samabri Biseni Field; https://onepetro.org/SPENAIC/proceedings-abstract/19NAIC/2-19NAIC/D023S007R003/219924; Aug. 2019.; 11 pages.

* cited by examiner

DYNAMIC REAL TIME GROSS RATE MONITORING THROUGH SUBSURFACE AND SURFACE DATA

FIELD OF THE DISCLOSURE

This patent application relates, generally, well flow rates and, more particularly, to applying indirect measurements for estimating a gross flow rate.

BACKGROUND OF THE DISCLOSURE

Continuous gross rate measurements of wells provide valuable information about reservoir behavior. Unfortunately, obtaining continuous measurements is often unfeasible because of a need for dedicated meters (e.g., flow meters) to be installed for every well in a field. In a typical installation, only one meter is installed per drill site or platform, and the meter is shared by multiple wells. When one of the wells is to be tested, its flow is diverted to the testing line for rate measurement. Such a setup may optimize costs, but can result in discontinuous and sparse measurements of rate. Well behavior that occurs between discrete measurements is often unknown, making accurate measurements of flow rate difficult or impossible.

In a typical arrangement, gross rate of a plurality of wells is measured via a single multiphase flow meter that is installed at a drill-site or platform. Measuring gross rate via a single multiphase flow meter is intermittent, which results in wells being tested once over a length of time, such as once per month, depending on the number of wells that are connected to a single flow meter. Measurement results are not timely and can be inaccurate, particularly as changes occur. Furthermore, a flow meter may be subject to drifting, which requires proper calibration. An uncalibrated flow meter can result in misleading results and, consequently, poor decision-making and management. Addressing these issues by providing a respective multiphase flow meter for each of a plurality of wells is impractical and expensive.

It is with respect to these and other concerns that the present disclosure is provided.

SUMMARY OF THE DISCLOSURE

In one or more implementations, a method and system are disclosed for estimating continuous gross rate of each of a plurality of wells. Information provided by sensors configured with each of a plurality of electrical submersible pumps is received. Information associated with a respective model of each of the plurality of electrical submersible pumps is accessed. Utilizing at least one of artificial intelligence and machine learning, the information provided by sensors and the information associated with the respective model of each of the plurality of electrical submersible pumps is processed to estimate a first gross rate of each of the plurality of wells. A second gross rate of each of the plurality of wells is estimated via a pipeline simulation that applies a physics-based model. A continuous gross rate for each of the plurality of wells is estimated as a function of the first gross rate and the second gross rate.

In one or more implementations, at least one computing device correlates at least one gross rate estimated by utilizing at least one of artificial intelligence and machine learning using information representing flowrate of at least one well that is physically measured. Further, the at least one computing device adjusts the at least one of the artificial intelligence and machine learning as a function of the correlating.

In one or more implementations, at least one computing device applies a quantic inflow performance equation. The result of the quantic inflow performance equation is substituted for a difference of measured intake pressure and measured discharge pressure of at least one of the electrical submersible pumps.

In one or more implementations, the quantic inflow performance equation applies a respective frequency of each respective electrical submersible pump head.

In one or more implementations, at least one computing device generates a pump performance curve for each of the plurality of electrical submersible pumps. Further, the at least one computing device applies at least some of the information provided by sensors and the information associated with the respective model of each of the plurality of electrical submersible pumps to the pump performance curve to estimate the second gross rate of each of the plurality of wells.

In one or more implementations, the processing of information by utilizing at least one of artificial intelligence and machine learning and provided by the sensors configured with each of the plurality of electrical submersible pumps includes well-head upstream pressure, electrical submersible pump upstream pressure, electrical submersible pump downstream pressure, electrical submersible pump motor speed, electrical submersible pump horsepower, sum of stages in the pump, and depth of electrical submersible pump installation.

In one or more implementations, at least some of the information that is associated with a respective model of each of the plurality of electrical submersible pumps includes a number of stages for each of the plurality of electrical submersible pumps. Further, at least one computing device is configured for determining, for each of the plurality of electrical submersible pumps, a head-per-stage value.

In one or more implementations, at least one computing device receives information measured by a multiphase flow meter, wherein the information represents a flowrate of at least one of the electrical submersible pumps. Further, the at least one computing device determines, by comparing the flowrate measured by the multiphase flow meter and at least information associated with the estimated continuous gross rate, a malfunction of the multiphase flow meter.

In one or more implementations, the information provided by the sensors includes well-head upstream pressure, electrical submersible pump upstream pressure, electrical submersible pump downstream pressure, electrical submersible pump motor speed, electrical submersible pump horsepower, sum of stages in a pump, and depth of an electrical submersible pump installation.

In one or more implementations, the pipeline simulation is provided as a function of at least one of intake pressure, discharge pressure, electrical submersible pump horsepower, electrical submersible pump motor speed, and a sum of stages in an electrical submersible pump.

Additional features, advantages, and embodiments of the disclosure may be set forth or apparent from consideration of the detailed description and drawings. It is to be understood that the foregoing summary of the disclosure and the following detailed description and drawings provide non-limiting examples that are intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

DETAILED DESCRIPTION OF CERTAIN EMBODIMENTS ACCORDING TO THE DISCLOSURE

Figure 1:
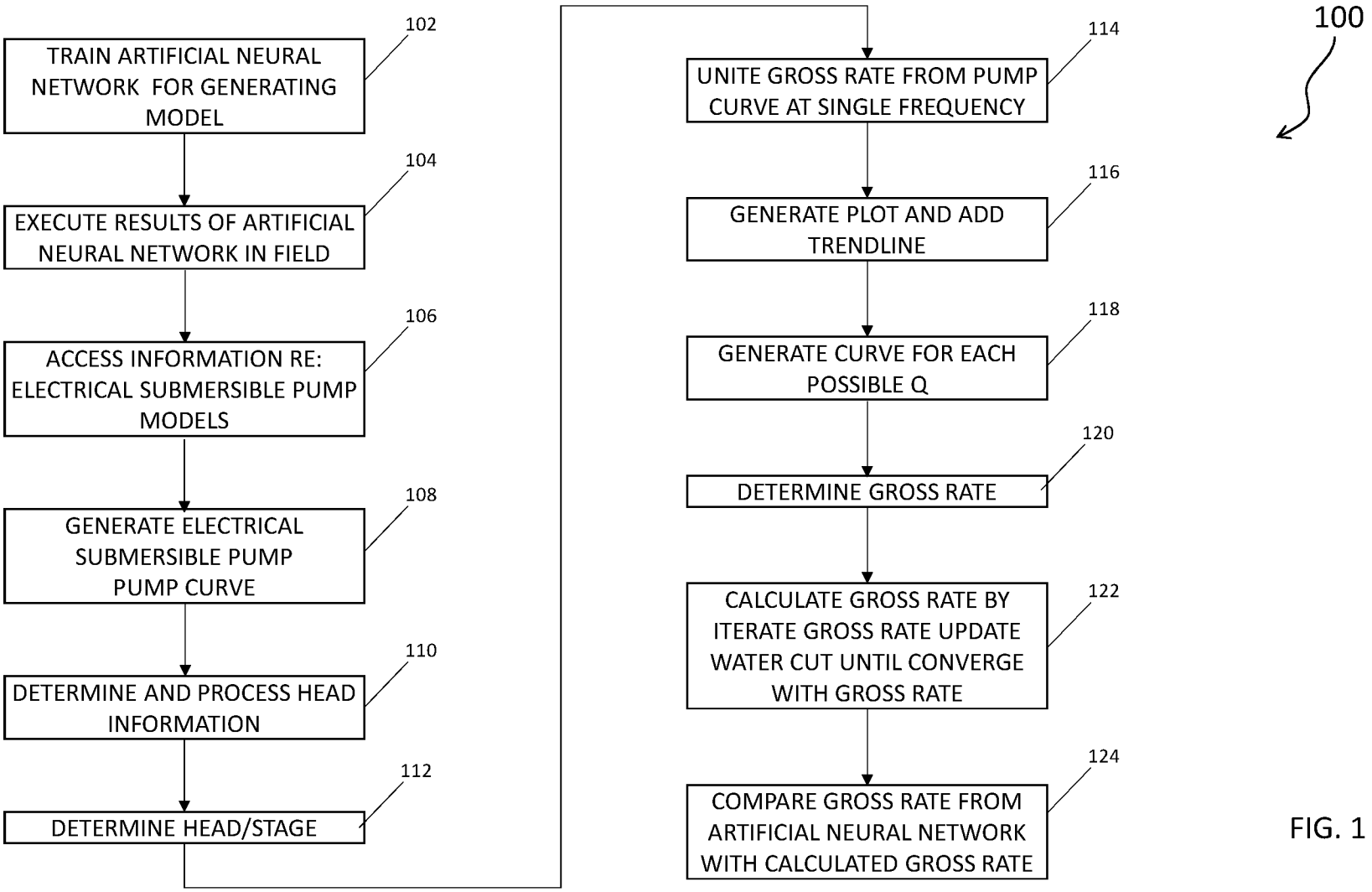
FIG. 1 is a flow diagram showing a routine that illustrates a broad aspect of the present disclosure, in accordance with one or more embodiments.

By way of overview and introduction, the present disclosure presents technical method(s) and system(s) to estimate gross rate of a plurality of wells in a field, substantially in real time. Techniques are provided to estimate well gross rate using indirect measurements, such as measured pressure and corresponding data received from electrical submersible pumps. The systems and methods provided herein avert a need for installations of respective physical flow meters and overcomes associated shortcomings, such as a need for on-site physical calibration. The present disclosure provides a data-driven approach that can include a physics-based model to estimate gross rate for a plurality of wells.

In one or more implementations, data can be transmitted from sensors configured with an electrical submersible pump, which can be received and correlated to measure and estimate gross rate. Data associated with seven parameters can be measured substantially in real time, including well-head upstream pressure, electrical submersible pump upstream pressure, electrical submersible pump downstream pressure, electrical submersible pump motor speed, electrical submersible pump horsepower, sum of stages in the pump, and depth of electrical submersible pump installation. Information associated with such parameters can processed by an artificial neural network to generate a model to estimate gross rate.

Moreover, a physics-based model can be applied to provide pipeline simulation, which can be based on wellbore physics and particular electrical submersible pump models installed in a field. A physics-based model in accordance with the present disclosure can process data, including intake and discharge pressures of electrical submersible pumps, electrical submersible pump motor speed, and sum of stages in the pump to provide pipeline simulation. For each pump installed in a field, a quantic inflow performance equation can be used to estimate the rate, substantially in real time, as a function of a pump performance curve associated with an electrical submersible pump. The results of the equation can, thereafter, be substituted for a measured difference between intake and discharge pressures of an electrical submersible pump, which can result in a real time reading of gross rate. Furthermore, a discrepancy between results from the models and measured results of an on-site flow meter can be addressed, including by testing to confirm the rates and for quality control of the flow meters or the respective models.

In one or more implementations of the present disclosure, steps associated with features set forth above can be executed by one or more computing devices. In addition, estimates of gross rate provided by the artificial neural network model can be correlated by electrical submersible pump parameters, such as a function of intake pressure, discharge pressure, horsepower, and motor speed. Such parameters can be correlated with one or more conducted tests by flow meters at the same date and time. A benefit of the present disclosure includes the artificial neural network model being applied over a field in areas where no rate tests are available. Further, specific equations, formulas, and fitting for calculating the pump performance curve associated with an electrical submersible pump and using the real time data are provided to determine well gross rate accurately, and for validating the determined gross rate. In one or more implementations, electrical submersible pump curves can be used to provide at least an approximate flow rate based on down hole measurements of each pump. For example, where the downhole pressure difference between intake and discharge pressures of the incoming fluid through the pump along with the bottom hole pressure is known, the flow rate of the pump can be estimated. It is recognized that each pump can have a respective performance curve, which can impact the accuracy of approximating flow rate, such as due to varying conditions of the respective operational environments. The present disclosure provides a model that is highly accurate to results estimate flow rates and water cuts, including based on historical and real-time data associated with operating pumps.

Accordingly, the present disclosure provides for estimating gross rate of wells, substantially in real time, using indirect measurements such as real time surface and subsurface pressure, electrical submersible pump frequency, and other electrical submersible pump parameters. In one or more implementations of the present disclosure, information can be received from wells equipped with electrical submersible pumps that have sensors transmitting data, substantially in real time. These data can be correlated to gross rate. An artificial neural network model can estimate gross rate using parameters described herein that are measured and transmitted during operation, including well-head upstream pressure, electrical submersible pump upstream pressure, electrical submersible pump downstream pressure, electrical submersible pump motor speed, electrical submersible pump horsepower, sum of stages in the pump, and depth of electrical submersible pump installation. In one or more implementations, the artificial neural network utilizes 50 hidden layers with 300 neurons, in which over than 52,000 data points derived from data are used to train the model. Such data points can include rows of historical data used in one or more machine learning applications. Once the data are inserted into the machine learning application, gross rate can be predicted and, thereafter, compared to available and actual existing rates. Machine learning can compare predicted results with the actual ones for deriving an accurate equation for inputted data. Thereafter a resultant equation can be tested further, using data that were not previously inputted into the application or had no corresponding gross rate information at the same time in history. The process can repeat until an equation is derived that accurately and consistently predicts gross rates trends on a well level and a field level. Hidden layers can refer to steps taken by the application to derive an accurate function. In one or more implementations, the fewer steps that are required indicates an increasing accuracy and applicability of the function.

Simultaneously, a physics-based model can utilize pump performance curves respectively associated with electrical submersible pumps, as well as other data that can be generated and transmitted, substantially in real time. Such data can include, for example, intake and discharge pressures of an electrical submersible pump, electrical submersible pump motor speed, and sum of stages in the pump. At least some of such data, for example, can be received from one or more sensors provided at the electrical submersible pump, as well as one or more devices configured to read the electrical submersible pump motor speed. The physics-based estimation method can be based on wellbore physics and information associated with respective pump models that are installed in a field. In one or more implementations of the present disclosure, a quantic inflow performance equation is developed and applied for each pump installed in a respective field, and results are substituted for measured differences electrical submersible pump intake pressure and discharge pressure, substantially in real time, thereby resulting in an accurate and timely estimation of gross rate, which eliminates a need for expensive and cumbersome on-site measurements and maintenance. Results can be corroborated and/or correlated by testing output of one or more electrical submersible pumps, such as using portable testing equipment, to confirm flow rates and ensure good quality control representing output of flow meters for respective electrical submersible pump models.

Accordingly, the present disclosure provides an improved alternative for estimating gross rate of wells accurately without requiring a reliance on physical flow meters, using indirect measurements, such as pressure and electrical submersible pump data, received substantially in real time. The alternative solution of the present disclosure includes a data-driven approach, including output of a physics-based model, to provide cost-effective, accurate, continuous, and timely estimates gross rate in the field. In one or more implementations, real time data received from electrical submersible pumps is processed using artificial intelligence and machine learning, and a physics-based model utilizing pump performance curves associated with electrical submersible pumps provide for continuity and improved accuracy.

Referring now to the drawings, FIG. 1 is a flow diagram illustrating steps associated with an example process 100 in accordance with an implementation of the present disclosure. It is to be appreciated that several of the logical operations described herein can be implemented as a sequence of computer-implemented acts or program modules running on one or more computing devices. Accordingly, the operations described herein, including logical operations, are referred to variously as operations, steps, structural devices, acts and modules can be implemented in software, in firmware, in special purpose digital logic, and any combination thereof. It should also be appreciated that more or fewer operations can be performed than shown in the figures and described herein. These operations can also be performed in a different order than those described herein.

At step 102, an artificial neural network is trained via machine learning using data points for generating a model. Various parameters associated with electrical submersible pumps including, for example, as intake pressure, discharge pressure, horsepower, motor speed, motor volts, ampere, and number of stages, as applied to the artificial neural network for estimating flow rate. The results of the model are tested using output from an electrical submersible pump flow meter to confirm an accurate correlation with actual output from a flow meter at a given date and time with the estimated flow rate. In the event of an inaccurate result, the model can be adjusted until an accurate correlation is achieved. For example, data noise can be identified during training and filtered to improve the model over time. Some forms of refinements can include reducing the number of inputted parameters, which have a lesser effect on the prediction of gross rate, such as motor volts and ampere. Further, frozen data from a sensor can be filtered out from inputted data to a machine learning, which precludes an undesired effect on a resultant estimation function. The resultant estimation function has a higher accuracy in predicting gross rates, when compared with actual gross rates at the same time.

After the training process and an accurate correlation with estimated flowrates and actual measured flowrates at respective pumps, the artificial neural network model is executed at a field that includes electrical submersible pumps (step 104). Information including, for example, the seven data point parameters described herein are used to generate flow rate estimates for pumps where no rate tests at particular dates and times are otherwise available. At least some of the data associated with the parameters can be transmitted from one or more devices at an electrical submersible pump and/or stored in one or more databases that can be accessed by the model (step 106). Different electrical submersible pump models have respective parameter information that is used by the artificial neural network model to provide accurate flow rate estimates. Using the parameter information, a pipeline simulator is utilized to generate a pump performance curve for each respective model of electrical submersible pump in use in one or more fields (step 108).

In one or more implementations, a value can be determined which represents the difference between pressure at intake and pressure at discharge (the "head") (step 110). The head value is converted, thereafter, into head-per-stage value, which can be calculated using a value representing the number of stages (e.g., comprising sets of an impeller and diffuser) of the respective electrical submersible pump. The number of stages associated with a respective electrical submersible pump can be retrieved from one or more databases. In addition, the head value can be converted from pound/square inch ("PSI") to foot of head ("FT") using the fluid gradient obtained from a determined pressure-volume-temperature ("PVT") for each reservoir. In addition, a gradient can be corrected based on water cut obtained.

Continuing with reference to FIG. 1, at step 112 a head/stage is calculated. In one or more implementations, the following equation can be used to calculate a head/stage for a given frequency (e.g., 60 Hz), although virtually any frequency can be used:

$$\Delta p_{@60} = \left(\frac{60}{\text{Frequency}}\right)^2 \left(\frac{\text{Head}}{\text{Stage}}\right)$$

Similarly, the gross rate from the pump performance curve can be united at one frequency (step 114). In one or more implementations, the following equation can be used to unite gross rate from pump performance curve at single frequency:

$$q_{@60} = 60\left(\frac{q}{\text{Frequency}}\right)$$

It is noted that, while virtually any frequency can be used, the same frequency should be used to calculate the gross rate from the pump performance curve to match the frequency of the head.

Thereafter, a plot is generated for the measured gross rate versus the gross rate calculated by the neural network (i.e., $q_{@60}$ vs. $\Delta p_{@60}$ and, thereafter, a trendline is added with a polynomial curve fitting at 5th degree, thereby representing total rates plotted versus time (step 116). Then a curve is generated for each possible q entered into the 5th degree equation, and a head can be generated at the frequency (e.g., 60 Hz) (step 118).

The data described herein that can be generated and/or calculated substantially in real time can be applied to the corresponding pump performance curve, such as generated in the process described above, and the well gross rate can be calculated therefrom (step 120). Based on the newly calculated gross rate, a water cut can be updated and repeatedly iterated until both water cut and gross rate converge (step 122). Moreover, the gross rate generated using the artificial neural network, as described above, is compared with gross rate generated using the physics-based model (step 124). Thereafter, an estimated final gross rate is generated continuously at real-time.

In one or more implementations of the present disclosure, computer instructions can be generated that, when executed by one more computing devices, provide a graphical user interface that includes one or more options for a user. For example, a user interface can be made available that includes graphical screen controls, such as drop-down lists, textboxes, buttons, checkboxes, as well as displays of informational in various graphical and textual formats.

Figure 4A:
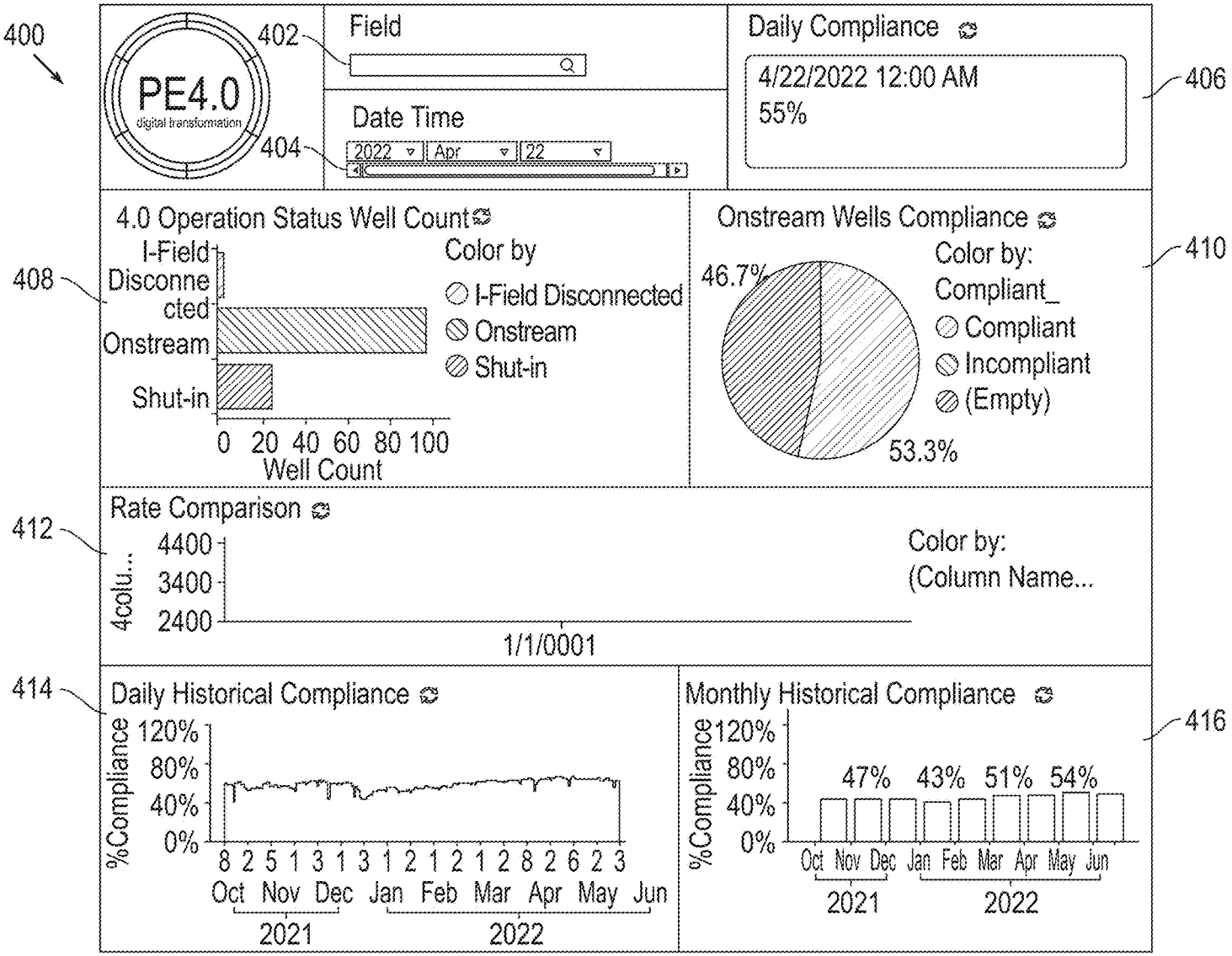
FIGS. 4A and 4B are example screen displays showing a user interface, prior to a user's selection of a well from a daily rate compliance table, in accordance with an implementation of the present disclosure.
Figure 4B:
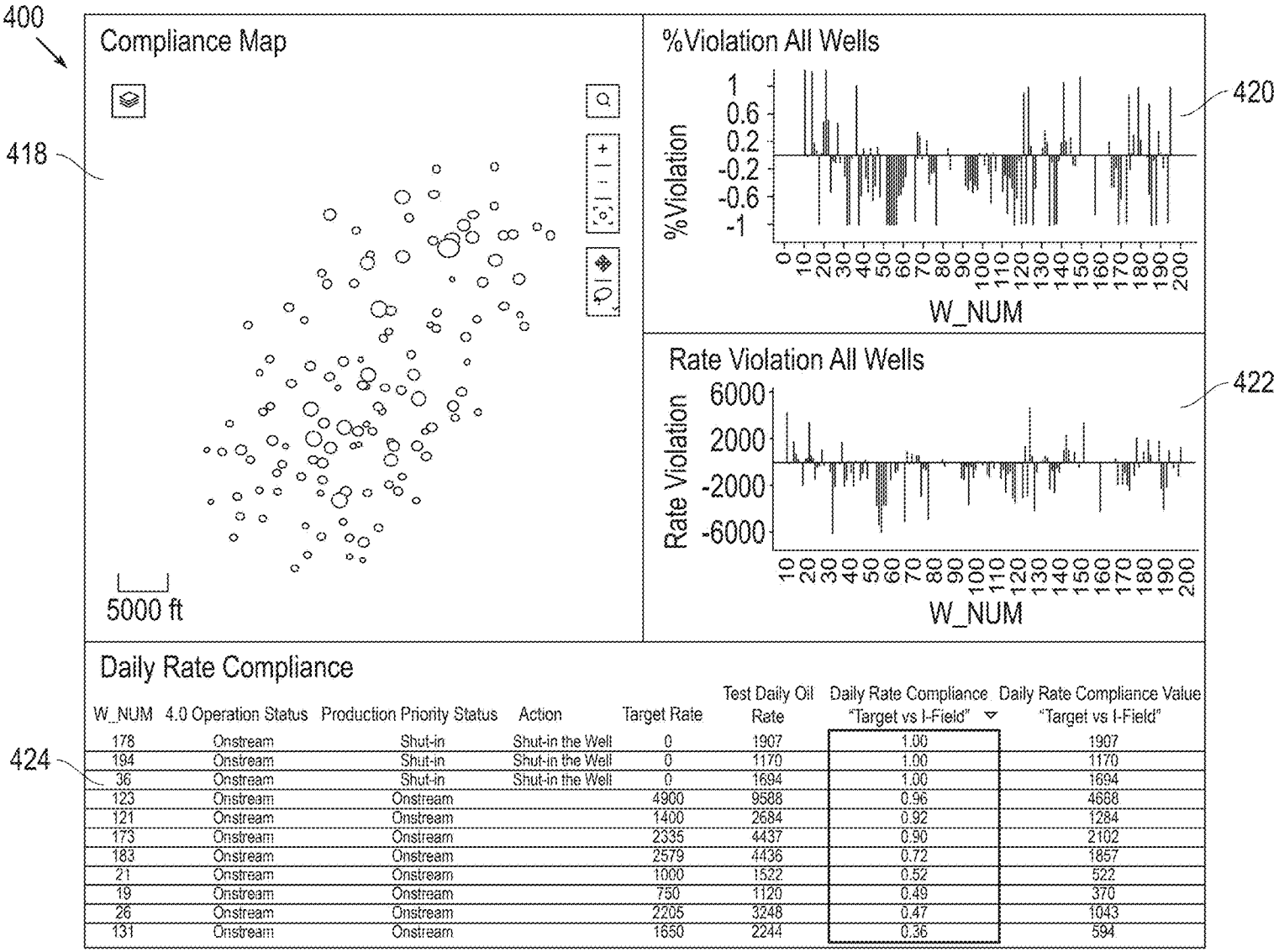
Figure 5A:
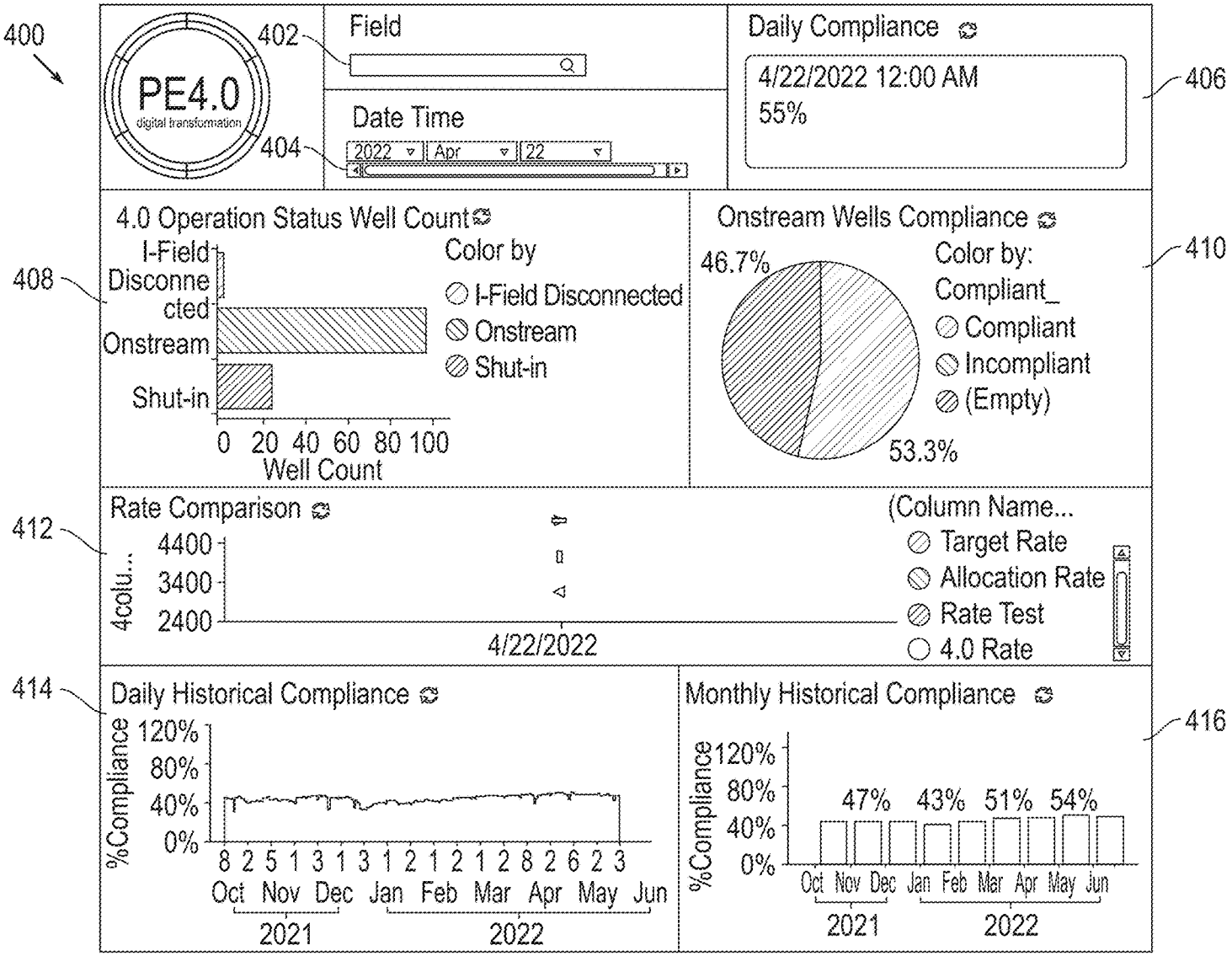
FIGS. 5A and 5B are example screen displays showing the user interface of FIGS. 4A and 4B, following a user's selection of a well from a daily rate compliance table, in accordance with an implementation of the present disclosure.
Figure 5B:
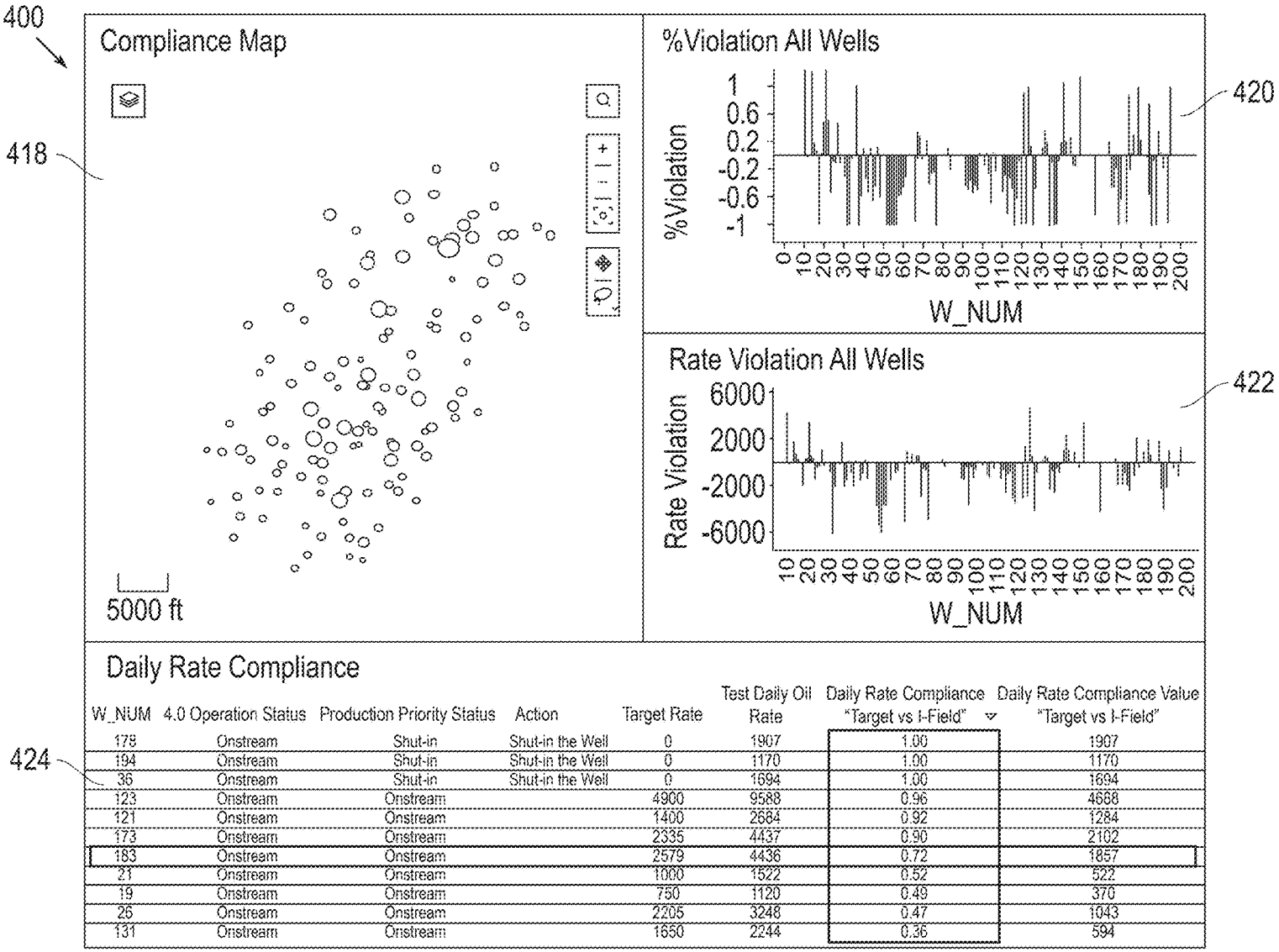

FIGS. 4A and 4B are example screen displays that are included in a user interface 400, in accordance with an implementation of the present disclosure. User interface 400 includes collections of graphical screens controls and displays that enable a user to view and interact within information representing the compliance of various rates, such as estimated from real-time measurement, including as targeted, allocated. and actually measured. Based on compliance comparison(s), the user can assess a production health of a given well and make decisions related to the well rate. The example shown in FIGS. 4A and 4B shows a first state of the user interface 400 prior to a user selecting a well from a daily rate compliance table. The example shown in FIGS. 5A and 5B shows a second state of the user interface 400, after a user has selected a well from the daily rate compliance table.

As illustrated in the example user interface 400 in FIGS. 4A, 4B, 5A, and 5B Field section 402 includes one or more controls that enable a user to search for and/or select a respective field of interest. Date Time section 404 includes one or more controls that enable a user to select a time and date for which rates comparison are to be shown displayed in user interface 400. Daily Compliance section 406 displays the selected date and a percentage of comparison. In one or more implementations, color coded compliance flags representing compliance of the well rates can be included, such as green representing compliance and red representing non-compliance. Also provided in example user interface 400 is Status Well Count section 408, which includes a graphical representation of a number of wells that are onstream, shut-in, or disconnected, based on real-time measurements. Onstream Wells Compliance section 410 includes a graphical representation of percentages of wells that are compliant and non-compliant. Rate Comparison section 412 provides rates comparison of various well of interest. Daily Historical Compliance section 414 includes a graphical representation of compliance percentages of a respective field on daily bases, and Monthly Historical Compliance 416 includes a graphical representation of compliance percentages of a field, on monthly bases.

With reference to FIG. 4B, Compliance Map section 418 includes a graphical scattering of a location of a respective well in relation to a field map, in which wells are colored to indicate a violation percentage between compared rates. Particular gradients of colors, such as reddish colors, can represent various degrees of violation. Further, % Violation All Wells section 420 includes a stacked column chart showing various violation percentages between estimated and targeted rates. For example, a positive value represents a higher estimated rate than a targeted value, while a negative value represents a lower estimated rate than a targeted value.

Continuing with reference to FIG. 4B, Rate Violation All Wells section 422 includes a stacked columns chart showing degrees of violation in values between estimated and targeted rates. A positive value represents a higher estimated rate than a targeted value, while a negative value represents a lower estimated rate than a targeted value. Daily Rate Compliance section 424 includes a table including various rows of information, including a number, operation status, an action, a target rate, a test daily oil rate, a daily rate compliance target vs. I-Field, and Daily Rate Compliance Value Target vs. I-Field. In one or more implementations, the data set forth in table in section 424 is selectable, thereby causing information provided in other sections (e.g., section 412) to update in accordance with the selection.

FIGS. 5A and 5B illustrate example screen displays that are included in user interface 400. In the example shown in FIGS. 5A and 5B, interface 400 is in an operational state following a user selecting a respective well from Daily Rate Compliance section 424.

Experimental testing conducted on field data with reservoirs of varying fluid properties confirmed the accuracy of accuracy gross rates. Validation results demonstrated high levels of matching estimated flow rates with measurements using flow meters and portable testing. In addition, in one or more implementations of the present disclosure omitted a substantial portion of training data (e.g., approximately 30%), which was used as blind data for validation. The results generated by the neural network provided a match with an R2 of 0.91.

Furthermore, the estimated gross rate results by the model can be compared to corresponding respective actual rate tests. Such comparison(s) can be done using graphing tools that identify to have a closer look on how close or off are the model gross rates compared to the gross rate tests measurements by flow meters. Moreover, this in-depth comparison determines the ranges of inputted parameters where the accuracy model estimated rate is high and where it is low, compared to flow meters rate tests history of the respective wells. The same process can be done while running the model on all field data (data points were no actual rate tests are done on the same date and time). In addition, the two models generated in accordance with the present disclosure (e.g., artificial intelligence model and physics-based model) generate results that are plotted with actual rate tests on the same time line, showing high match between the three measurements.

Figure 2:
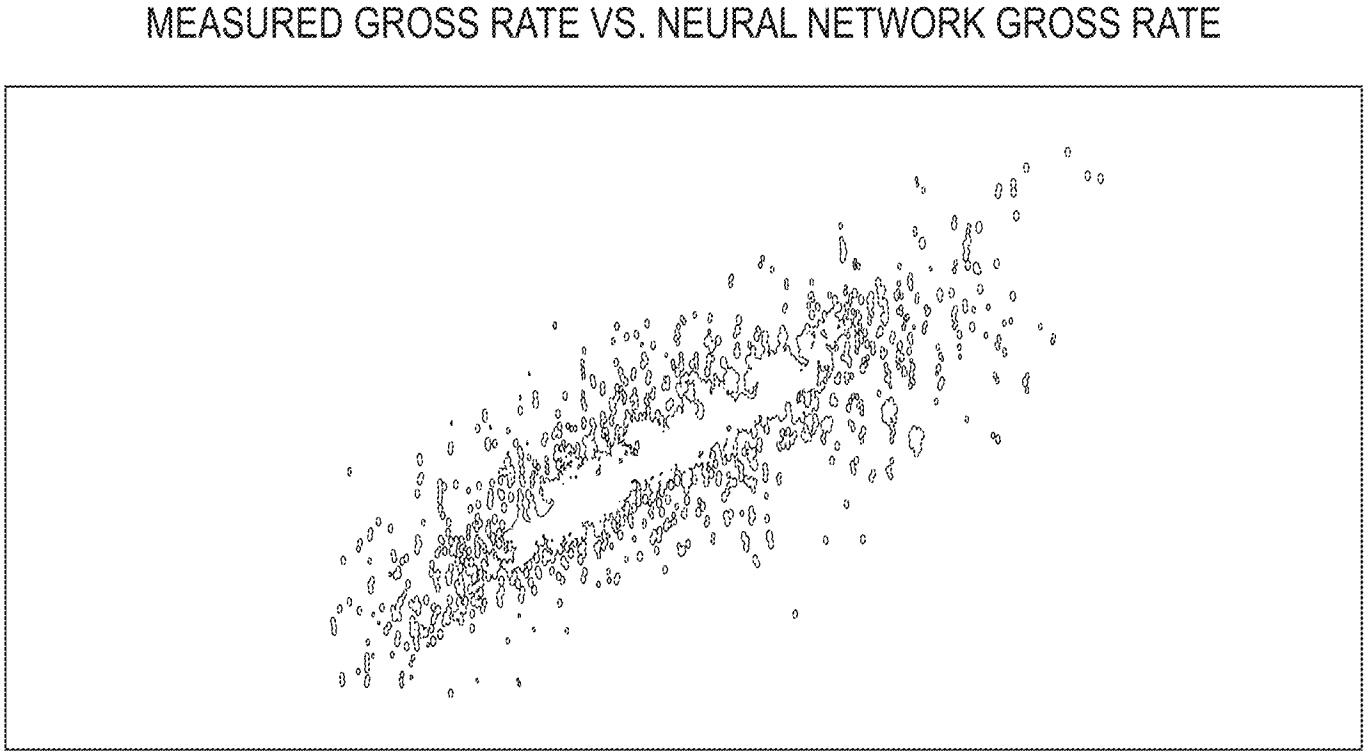
FIG. 2 is a graph illustrating a comparison of measured gross rates and gross rates estimated by an artificial neural network and represents the high degree of correlation between the two.
Figure 3:
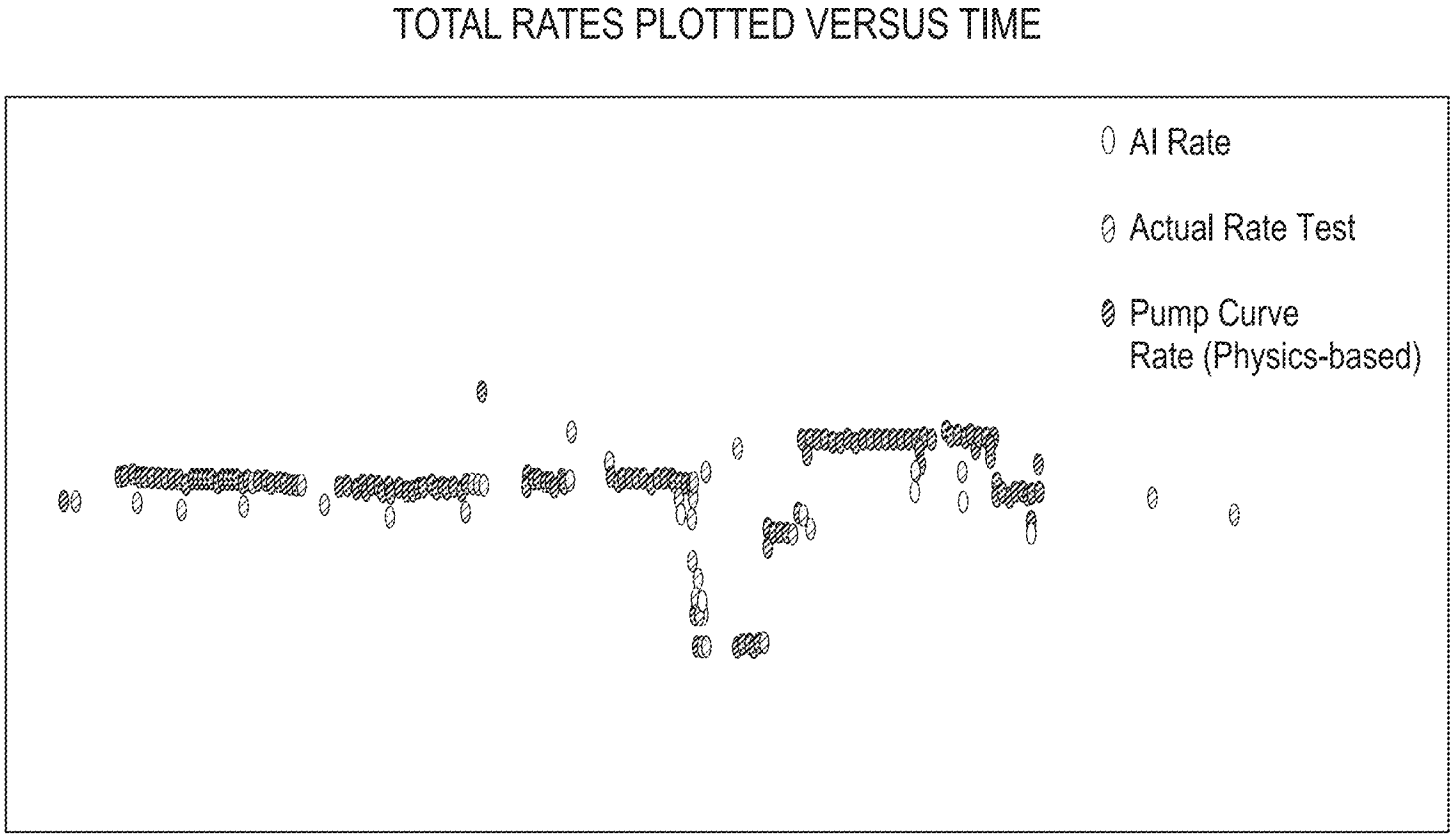
FIG. 3 is a graph illustrating a comparison of gross rates estimated by a neural network, measured gross rates, and estimated pump performance curve rates in accordance with the teachings herein.

FIG. 2 is a graph illustrating a comparison of measured gross rates and gross rates estimated by an artificial neural network and represents the high degree of correlation between the two. FIG. 3 is a graph illustrating a comparison of gross rates estimated by a neural network, measured gross rates, and estimated pump performance curve rates in accordance with the teachings herein.

In one or more implementations, the model was initially developed to use 13 parameters and then taken down to seven inputs based on statistical analysis. Out of these seven inputs, only four include real-time data, while the rest are fixed design parameters. For the physics-based model, only three parameters are real time. In one or more implementations, certain parameters, such as motor voltage, motor amperage, motor horsepower, pump length, pump diameter, and well head temperature, were eliminated following analyses of outputs of machine learning operations. Parameters that were derived as providing little to no correlation of results of flow rate estimation were eliminated following repeated machine learning operations and artificial neural network processing.

In accordance with the teachings herein, continuous gross rate estimation is provided substantially in real-time. Using such estimates can provide various benefits. For example, benchmarking can be provided for multiphase flow meters using the continuous gross rate estimation of the present disclosure. Further, malfunctioning flow meters can be identified using the continuous gross rate estimation of the present disclosure. Moreover, flow meter calibration frequencies and scheduling can be optimized, using the continuous gross rate estimation of the present disclosure. Still further, using the continuous gross rate estimation of the present disclosure can result in interpolating between often sparsely taken gross rate measurements. Additionally, using the continuous gross rate estimation of the present disclosure, production allocation per well can be made. Moreover, production in the field can be estimated, including as accompanied with a water cut estimation dashboard. The present can be implemented in many fields equipped with electrical submersible pumps.

Figure 6:
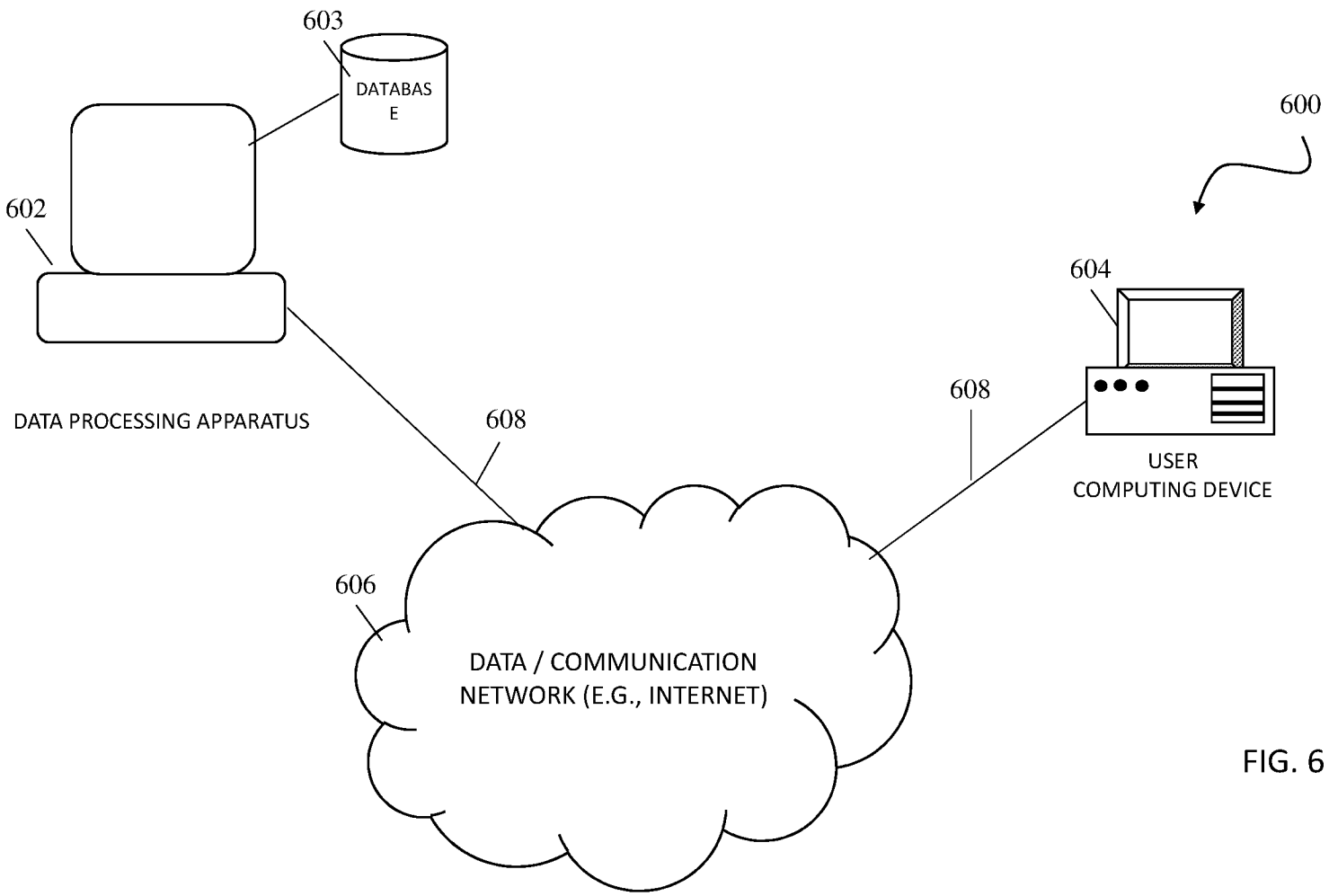
FIG. 6 is a block diagram that shows an example hardware arrangement that operates for providing the systems and methods disclosed herein.

Referring to FIG. 6, a diagram is provided that shows an example hardware arrangement that operates for providing the systems and methods disclosed herein and designated generally as system 600. System 600 can include one or more information processors 602 that are at least communicatively coupled to one or more user computing devices 604 across communication network 606. Information processors 602 and user computing devices 604 can include, for example, mobile computing devices such as tablet computing devices, smartphones, personal digital assistants or the like, as well as laptop computers and/or desktop computers, server computers and mainframe computers. Further, one computing device may be configured as an information processor 602 and a user computing device 604, depending upon operations being executed at a particular time.

With continued reference to FIG. 6, information processor 602 can be configured to access one or more databases 603 for the present disclosure, including source code repositories and other information. However, it is contemplated that information processor 602 can access any required databases via communication network 606 or any other communication network to which information processor 602 has access. Information processor 602 can communicate with devices comprising databases using any known communication method, including a direct serial, parallel, universal serial bus ("USB") interface, or via a local or wide area network.

User computing devices 604 can communicate with information processors 602 using data connections 608, which are respectively coupled to communication network 606. Communication network 606 can be any communication network, but typically is or includes the Internet or other computer network. Data connections 608 can be any known arrangement for accessing communication network 606, such as the public internet, private Internet (e.g. VPN), dedicated Internet connection, or dial-up serial line interface protocol/point-to-point protocol (SLIPP/PPP), integrated services digital network (ISDN), dedicated leased-line service, broadband (cable) access, frame relay, digital subscriber line (DSL), asynchronous transfer mode (ATM) or other access techniques.

User computing devices 604 preferably have the ability to send and receive data across communication network 606, and are equipped with web browsers, software disclosures, or other means, to provide received data on display devices incorporated therewith. By way of example, user computing device 604 may be personal computers such as Intel Pentium-class and Intel Core-class computers or Apple Macintosh computers, tablets, smartphones, but are not limited to such computers. Other computing devices which can communicate over a global computer network such as palmtop computers, personal digital assistants (PDAs) and mass-marketed Internet access devices such as WebTV can be used. In addition, the hardware arrangement of the present invention is not limited to devices that are physically wired to communication network 606, and that wireless communication can be provided between wireless devices and information processors 602.

System 600 preferably includes software that provides functionality described in greater detail herein, and preferably resides on one or more information processors 602 and/or user computing devices 604. One of the functions performed by information processor 602 is that of operating as a web server and/or a web site host. Information processors 602 typically communicate with communication network 606 across a permanent i.e., un-switched data connection 608. Permanent connectivity ensures that access to information processors 602 is always available.

Figure 7:
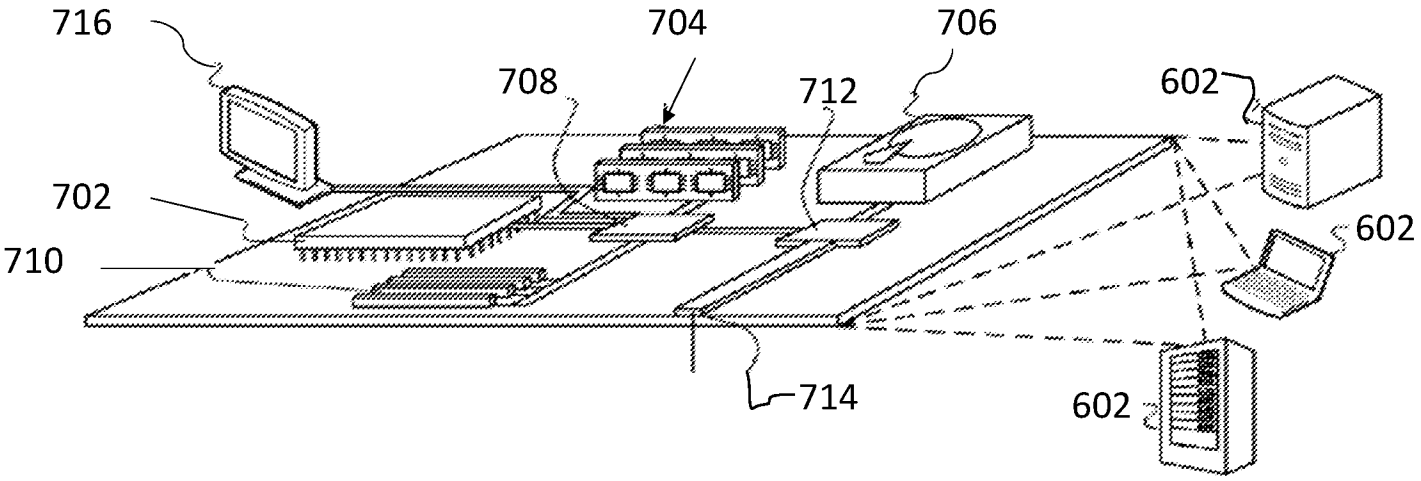
FIG. 7 shows an example of an information processor that can be used to implement the techniques described herein the present disclosure.

FIG. 7 shows an example information processor 602 that can be used to implement the techniques described herein. The information processor 602 is intended to represent various forms of digital computers, such as laptops, desktops, workstations, personal digital assistants, servers, blade servers, mainframes, and other appropriate computers. The components shown in FIG. 7, including connections and relationships, and their functions, are meant to be exemplary only, and are not meant to limit implementations of the inventions described and/or claimed in this document.

The information processor 602 includes a processor 702, a memory 704, a storage device 706, a high-speed interface 708 connecting to the memory 704 and multiple high-speed expansion ports 710, and a low-speed interface 712 connecting to a low-speed expansion port 714 and the storage device 706. Each of the processor 702, the memory 704, the storage device 706, the high-speed interface 708, the high-speed expansion ports 710, and the low-speed interface 712, are interconnected using various busses, and can be mounted on a common motherboard or in other manners as appropriate. The processor 702 can process instructions for execution within the information processor 602, including instructions stored in the memory 704 or on the storage device 706 to display graphical information for a GUI on an external input/output device, such as a display 716 coupled to the high-speed interface 708. In other implementations, multiple processors and/or multiple buses can be used, as appropriate, along with multiple memories and types of memory. Also, multiple computing devices can be connected, with each device providing portions of the necessary operations (e.g., as a server bank, a group of blade servers, or a multiprocessor system).

The memory 704 stores information within the information processor 602. In some implementations, the memory 704 is a volatile memory unit or units. In some implementations, the memory 704 is a non-volatile memory unit or units. The memory 704 can also be another form of computer-readable medium, such as a magnetic or optical disk.

The storage device 706 is capable of providing mass storage for the information processor 602. In some implementations, the storage device 706 can be or contain a computer-readable medium, e.g., a computer-readable storage medium such as a floppy disk device, a hard disk device, an optical disk device, or a tape device, a flash memory or other similar solid-state memory device, or an array of devices, including devices in a storage area network or other configurations. A computer program product can also be tangibly embodied in an information carrier. The computer program product can also contain instructions that, when executed, perform one or more methods, such as those described above. The computer program product can also be tangibly embodied in a computer- or machine-readable medium, such as the memory 704, the storage device 706, or memory on the processor 702.

The high-speed interface 708 can be configured to manage bandwidth-intensive operations, while the low-speed interface 712 can be configured to manage lower bandwidth-intensive operations. Of course, one of ordinary skill in the art will recognize that such allocation of functions is exemplary only. In some implementations, the high-speed interface 708 is coupled to the memory 704, the display 716 (e.g., through a graphics processor or accelerator), and to the high-speed expansion ports 710, which can accept various expansion cards (not shown). In an implementation, the low-speed interface 712 is coupled to the storage device 706 and the low-speed expansion port 714. The low-speed expansion port 714, which can include various communication ports (e.g., USB, Bluetooth, Ethernet, wireless Ethernet) can be coupled to one or more input/output devices, such as a keyboard, a pointing device, a scanner, or a networking device such as a switch or router, e.g., through a network adapter.

As noted herein, the information processor 602 can be implemented in a number of different forms, as shown in the figure. For example, it can be implemented as a standard server, or multiple times in a group of such servers. In addition, it can be implemented in a personal computer such as a laptop computer. It can also be implemented as part of a rack server system. Alternatively, components from the computing device 200 can be combined with other components in a mobile device (not shown), such as a mobile computing device.

The terms "a," "an," and "the," as used in this disclosure, means "one or more," unless expressly specified otherwise.

The term "communicating device," as used in this disclosure, means any hardware, firmware, or software that can transmit or receive data packets, instruction signals or data signals over a communication link. The hardware, firmware, or software can include, for example, a telephone, a smart phone, a personal data assistant (PDA), a smart watch, a tablet, a computer, a software defined radio (SDR), or the like, without limitation.

The term "communication link," as used in this disclosure, means a wired and/or wireless medium that conveys data or information between at least two points. The wired or wireless medium can include, for example, a metallic conductor link, a radio frequency (RF) communication link, an Infrared (IR) communication link, an optical communication link, or the like, without limitation. The RF communication link can include, for example, Wi-Fi, WiMAX, IEEE 802.11, DECT, 0G, 1G, 2G, 3G or 4G cellular standards, Bluetooth, or the like, without limitation.

The terms "computer" or "computing device," as used in this disclosure, means any machine, device, circuit, component, or module, or any system of machines, devices, circuits, components, modules, or the like, which are capable of manipulating data according to one or more instructions, such as, for example, without limitation, a processor, a microprocessor, a central processing unit, a general purpose computer, a super computer, a personal computer, a laptop computer, a palmtop computer, a notebook computer, a desktop computer, a workstation computer, a server, a server farm, a computer cloud, or the like, or an array of processors, microprocessors, central processing units, general purpose computers, super computers, personal computers, laptop computers, palmtop computers, notebook computers, desktop computers, workstation computers, servers, or the like, without limitation.

The term "computer-readable medium," as used in this disclosure, means any storage medium that participates in providing data (for example, instructions) that can be read by a computer. Such a medium can take many forms, including non-volatile media and volatile media. Non-volatile media can include, for example, optical or magnetic disks and other persistent memory. Volatile media can include dynamic random access memory (DRAM). Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read. The computer-readable medium can include a "Cloud," which includes a distribution of files across multiple (e.g., thousands of) memory caches on multiple (e.g., thousands of) computers.

Various forms of computer readable media can be involved in carrying sequences of instructions to a computer. For example, sequences of instruction (i) can be delivered from a RAM to a processor, (ii) can be carried over a wireless transmission medium, and/or (iii) can be formatted according to numerous formats, standards or protocols, including, for example, Wi-Fi, WiMAX, IEEE 802.11, DECT, 0G, 1G, 2G, 3G, 4G, or 5G cellular standards, Bluetooth, or the like.

The terms "transmission" and "transmit," as used in this disclosure, refer to the conveyance of signals via electricity, acoustic waves, light waves and other electromagnetic emissions, such as those generated in connection with communications in the radio frequency (RF) or infrared (IR) spectra. Transmission media for such transmissions can include coaxial cables, copper wire and fiber optics, including the wires that comprise a system bus coupled to the processor.

The term "database," as used in this disclosure, means any combination of software and/or hardware, including at least one disclosure and/or at least one computer. The database can include a structured collection of records or data organized according to a database model, such as, for example, but not limited to at least one of a relational model, a hierarchical model, a network model or the like. The database can include a database management system disclosure (DBMS) as is known in the art. The disclosure may include, but is not limited to, for example, an disclosure program that can accept connections to service requests from clients by sending back responses to the clients. The database can be configured to run the disclosure, often under heavy workloads, unattended, for extended periods of time with minimal human direction.

The terms "including," "comprising" and variations thereof, as used in this disclosure, mean "including, but not limited to," unless expressly specified otherwise.

The term "network," as used in this disclosure means, but is not limited to, for example, at least one of a local area network (LAN), a wide area network (WAN), a metropolitan area network (MAN), a personal area network (PAN), a campus area network, a corporate area network, a global area network (GAN), a broadband area network (BAN), a cellular network, the Internet, or the like, or any combination of the foregoing, any of which can be configured to communicate data via a wireless and/or a wired communication medium. These networks can run a variety of protocols not limited to TCP/IP, IRC or HTTP.

The term "server," as used in this disclosure, means any combination of software and/or hardware, including at least one disclosure and/or at least one computer to perform services for connected clients as part of a client-server architecture. The server disclosure can include, but is not limited to, for example, an disclosure program that can accept connections to service requests from clients by sending back responses to the clients. The server can be configured to run the disclosure, often under heavy workloads, unattended, for extended periods of time with minimal human direction. The server can include a plurality of computers configured, with the disclosure being divided among the computers depending upon the workload. For example, under light loading, the disclosure can run on a single computer. However, under heavy loading, multiple computers can be required to run the disclosure. The server, or any if its computers, can also be used as a workstation.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

The invention encompassed by the present disclosure has been described with reference to the accompanying drawings, which form a part hereof, and which show, by way of illustration, example implementations and/or embodiments. As such, the figures and examples above are not meant to limit the scope of the present disclosure to a single implementation, as other implementations are possible by way of interchange of some or all of the described or illustrated elements, without departing from the spirit of the present disclosure. Among other things, for example, the disclosed subject matter can be embodied as methods, devices, components, or systems.

Moreover, where certain elements of the present disclosure can be partially or fully implemented using known components, only those portions of such known components that are necessary for an understanding of the present disclosure are described, and detailed descriptions of other portions of such known components are omitted so as not to obscure the disclosure. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present disclosure encompasses present and future known equivalents to the known components referred to herein by way of illustration.

Furthermore, it is recognized that terms used herein can have nuanced meanings that are suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter can be based upon combinations of individual example embodiments, or combinations of parts of individual example embodiments.

The foregoing description of the specific implementations will so fully reveal the general nature of the disclosure that others can, by applying knowledge within the skill of the relevant art(s) (including the contents of the documents cited and incorporated by reference herein), readily modify and/or adapt for various disclosures such specific implementations, without undue experimentation, without departing from the general concept of the present disclosure. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown of drawings are shown accordingly to one example and other dimensions can be used without departing from the present disclosure.

While various implementations of the present disclosure have been described above, it should be understood that they have been presented by way of example, and not limitation. It would be apparent to one skilled in the relevant art(s) that various changes in form and detail could be made therein without departing from the spirit and scope of the disclosure. Thus, the present disclosure should not be limited by any of the above-described example implementations, and the invention is to be understood as being defined by the recitations in the claims which follow and structural and functional equivalents of the features and steps in those recitations.

The invention claimed is:

1. A computer-implemented method for estimating continuous gross rate of each of a plurality of wells that do not have available rate testing, the method comprising:

training, by at least one computing device, a model to predict a well's continuous gross rate, wherein the training includes:

processing historical well information that is respectively associated with at least one pump associated with a well, wherein the historical well information represents well-head upstream pressure, pump upstream pressure, pump downstream pressure, pump motor speed, pump horsepower, sum of stages, and depth of pump installation;

generating, as a function of the processed historical well information, a continuous gross rate prediction for the well;

testing the continuous gross rate prediction for the well using historical well output information representing continuous gross rate of the well;

repeating the steps of processing the historical well information, generating the continuous gross rate prediction for the well, and testing the continuous gross rate prediction for the well until the continuous gross rate prediction for the well consistently correlates with the historical well information; and providing, after the continuous gross rate prediction for the well consistently correlates with the historical well information, the trained model;

receiving, by the at least one computing device, information including measurements obtained from an active well that does not have available rate testing and is associated with each of a plurality of electrical submersible pumps, wherein the information includes:

respective pump model; respective wellhead upstream pressure;

respective electrical submersible pump upstream pressure; respective electrical submersible pump downstream pressure; respective electrical submersible pump motor speed; respective electrical submersible pump horsepower; respective sum of stages in a respective pump; and respective depth of electrical submersible pump installation;

processing, by the at least one computing device using the trained model, the received measurements associated with each of the at least one electrical submersible pump;

generating, by the at least one computing device as a function of processing the received measurements, a continuous gross rate prediction of the active well;

correlating, by the at least one computing device, at least one gross rate estimated by utilizing at least one of artificial intelligence and machine learning using information representing flowrate of at least one well that is physically measured; and adjusting, by the at least one computing device, the at least one of the artificial intelligence and machine learning as a function of the correlating.

2. The method of claim 1, further comprising applying, by the at least one computing device, a quantic inflow performance equation; and substituting, by the at least one computing device, a result of the quantic inflow performance equation for a difference of measured intake pressure and measured discharge pressure of at least one of the electrical submersible pumps.

3. The method of claim 2, wherein the quantic inflow performance equation applies a respective frequency of each respective electrical submersible pump head.

4. The method of claim 3, further comprising:

generating, by the at least one computing device, a pump performance curve for each of the plurality of electrical submersible pumps; and applying, by the at least one computing device, at least some of the information provided by sensors and the information associated with the respective model of each of the plurality of electrical submersible pumps to the pump performance curve to estimate the second gross rate of each of the plurality of wells.

5. The method of claim 1, wherein the information processing by utilizing at least one of artificial intelligence and machine learning and provided by the sensors configured with each of the plurality of electrical submersible pumps includes well-head upstream pressure, electrical submersible pump upstream pressure, electrical submersible pump downstream pressure, electrical submersible pump motor speed, electrical submersible pump horsepower, sum of stages in the pump, and depth of electrical submersible pump installation.

6. The method of claim 1, wherein at least some of the information that is associated with a respective model of each of the plurality of electrical submersible pumps includes a number of stages for each of the plurality of electrical submersible pumps, and further comprising:

determining, by the least one computing device for each of the plurality of electrical submersible pumps, a head-per-stage value.

7. The method of claim 1, further comprising:

receiving, by the at least one computing device, information measured by a multiphase flow meter, wherein the information represents a flowrate of at least one of the electrical submersible pumps; and determining, by the at least one computing device comparing the flowrate measured by the multiphase flow meter and at least information associated with the estimated continuous gross rate, a malfunction of the multiphase flow meter.

8. The method of claim 1, wherein the information provided by the sensors includes well-head upstream pressure, electrical submersible pump upstream pressure, electrical submersible pump downstream pressure, electrical submersible pump motor speed, electrical submersible pump horsepower, sum of stages in a pump, and depth of an electrical submersible pump installation.

9. The method of claim 1, wherein the pipeline simulation is provided as a function of at least one of intake pressure, discharge pressure, electrical submersible pump horsepower, electrical submersible pump motor speed, and a sum of stages in an electrical submersible pump.

10. A computer-implemented system for estimating continuous gross rate of each of a plurality of wells that do not have available rate testing, the system comprising:

at least one computing device, wherein the at least one computing device is configured by executing instructions for:

training a model to predict a well's continuous gross rate, wherein the training includes:

processing historical well information that is respectively associated with at least one pump associated with a well, wherein the historical well information represents well-head upstream pressure, pump upstream pressure, pump downstream pressure, pump motor speed, pump horsepower, sum of stages, and depth of pump installation;

generating, as a function of the processed historical well information, a continuous gross rate prediction for the well;

testing the continuous gross rate prediction for the well using historical well output information representing continuous gross rate of the well;

repeating the steps of processing the historical well information, generating the continuous gross rate prediction for the well, and testing the continuous gross rate prediction for the well until the continuous gross rate prediction for the well consistently correlates with the historical well information; and providing, after the continuous gross rate prediction for the well consistently correlates with the historical well information, the trained model;

receiving information including measurements obtained from an active well that does not have available rate testing and is associated with each of a plurality of electrical submersible pumps, wherein the information includes:

respective pump model; respective wellhead upstream pressure; respective electrical submersible pump upstream pressure; respective electrical submersible pump downstream pressure; respective electrical submersible pump motor speed; respective electrical submersible pump horsepower; respective sum of stages in a respective pump; and respective depth of electrical submersible pump installation;

processing, using the trained model, the received measurements associated with each of the at least one electrical submersible pump;

generating, as a function of processing the received measurements, a continuous gross rate prediction of the active well-;

correlating at least one gross rate estimated by utilizing at least one of artificial intelligence and machine learning using information representing flowrate of at least one well that is physically measured; and adjusting the at least one of the artificial intelligence and machine learning as a function of the correlating.

11. The system of claim 10, wherein the at least one computing device is configured by executing instructions for:

applying, by the at least one computing device, a quantic inflow performance equation; and substituting, by the at least one computing device, a result of the quantic inflow performance equation for a difference of measured intake pressure and measured discharge pressure of at least one of the electrical submersible pumps.

12. The system of claim 11, wherein the quantic inflow performance equation applies a respective frequency of each respective electrical submersible pump head.

13. The system of claim 11, wherein the at least one computing device is configured by executing instructions for:

generating a pump performance curve for each of the plurality of electrical submersible pumps; and applying at least some of the information provided by sensors and the information associated with the respective model of each of the plurality of electrical submersible pumps to the pump performance curve to estimate the second gross rate of each of the plurality of wells.

14. The system of claim 10, wherein the information processing by utilizing at least one of artificial intelligence and machine learning and provided by the sensors configured with each of the plurality of electrical submersible pumps includes well-head upstream pressure, electrical submersible pump upstream pressure, electrical submersible pump downstream pressure, electrical submersible pump motor speed, electrical submersible pump horsepower, sum of stages in the pump, and depth of electrical submersible pump installation.

15. The system of claim 10, wherein at least some of the information that is associated with a respective model of each of the plurality of electrical submersible pumps includes a number of stages for each of the plurality of electrical submersible pumps, and further wherein the at least one computing device is configured by executing instructions for:

determining, for each of the plurality of electrical submersible pumps, a head-per-stage value.

16. The system of claim 10, wherein the at least one computing device is configured by executing instructions for:

receiving information measured by a multiphase flow meter, wherein the information represents a flowrate of at least one of the electrical submersible pumps; and determining, by comparing the flowrate measured by the multiphase flow meter and at least information associated with the estimated continuous gross rate, a malfunction of the multiphase flow meter.

17. The system of claim 10, wherein the information provided by the sensors includes well-head upstream pressure, electrical submersible pump upstream pressure, electrical submersible pump downstream pressure, electrical submersible pump motor speed, electrical submersible pump horsepower, sum of stages in a pump, and depth of an electrical submersible pump installation.

18. The system of claim 10, wherein the pipeline simulation is provided as a function of at least one of intake pressure, discharge pressure, electrical submersible pump horsepower, electrical submersible pump motor speed, and a sum of stages in an electrical submersible pump.

* * * * *